United States Patent [19]

Holdsworth

[11] 4,347,042

[45] Aug. 31, 1982

[54] MOTOR COMPRESSOR UNIT AND A METHOD OF REDUCING NOISE TRANSMITTED THEREFROM

[75] Inventor: Timothy M. Holdsworth, Chittenango, N.Y.

[73] Assignee: Carrier Corporation, Syracuse, N.Y.

[21] Appl. No.: 155,870

[22] Filed: Jun. 2, 1980

[51] Int. Cl.[3] ..... F04B 39/00

[52] U.S. Cl. ..... 417/53; 181/202; 417/313; 417/902

[58] Field of Search ..... 417/53, 902, 312, 313, 417/363; 181/200, 202, 204, 256, 282

[56] References Cited

U.S. PATENT DOCUMENTS

| | | | |
|---|---|---|---|
| 3,273,670 | 9/1966 | Kleinlein | 188/1 B |
| 3,723,027 | 3/1973 | Montelius | 417/313 |
| 3,857,652 | 12/1974 | Thayer | 417/312 |
| 3,960,237 | 6/1976 | Sleeper | 181/200 |
| 4,201,523 | 5/1980 | Olofsson | 417/313 |

FOREIGN PATENT DOCUMENTS

| | | | |
|---|---|---|---|
| 52-45716 | 4/1977 | Japan | 417/313 |

OTHER PUBLICATIONS

"Y-Line Two Pole Motor Compressors", by Copeland Corporation, Feb., 1974.

*Primary Examiner*—Carlton R. Croyle
*Assistant Examiner*—Edward Look
*Attorney, Agent, or Firm*—J. Raymond Curtin; John S. Sensny

[57] ABSTRACT

A motor compressor unit and a method of reducing noise transmitted therefrom. The motor compressor unit comprises a compressor for compressing a vapor, a motor for driving the compressor, a shell encompassing the compressor and motor, and a supply of lubricant disposed within the shell. The motor compressor unit further comprises a lubricant absorbent, fibrous material positioned against interior surfaces of the shell for dampening sound waves generated within the motor compressor unit, and a cover positioned between the lubricant supply and the fibrous material for separating the fibrous material from the lubricant supply and preventing contamination thereof by the fibrous material.

6 Claims, 1 Drawing Figure

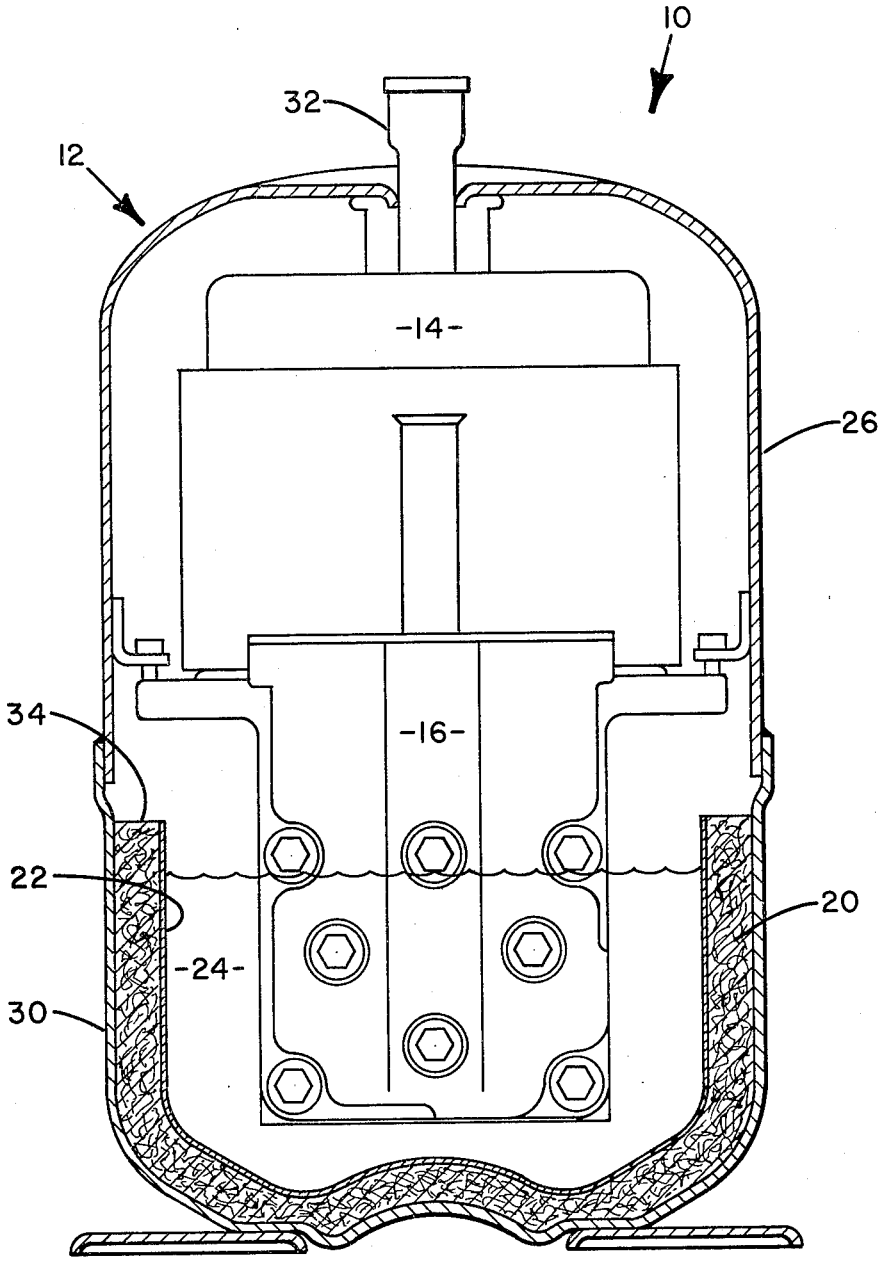
10
32
12
-14-
26
34
-16-
22
20
-24-
30

MOTOR COMPRESSOR UNIT AND A METHOD OF REDUCING NOISE TRANSMITTED THEREFROM

BACKGROUND OF THE INVENTION

This invention generally relates to motor compressor units, and more particularly to an arrangement for reducing noise transmitted therefrom.

Motor compressor units are widely used in refrigeration applications such as residential air conditioning. When used in such an application, a motor compressor unit is commonly located in or near one or more residential buildings. For example, the well known room air conditioner is usually mounted in a window or installed through a wall of the room which is cooled by the air conditioner. With other types of residential air conditioning systems, a motor compressor unit is positioned outside the conditioned room or building on a concrete slab or similar foundation, and often the motor compressor unit is near not only the conditioned room or building but also neighboring structures.

Many obvious advantages such as compactness and accessibility may result from locating the motor compressor unit in or near the conditioned space. However, disadvantages may also result. Specifically, motor compressor units of the type generally used in residential air conditioning systems have heretofore been a principal source of noise. When such a motor compressor unit is located in or near a building, the noise generated by the unit may exceed defined levels of sound as established by certain municipalities.

SUMMARY OF THE INVENTION

In view of the above, an object of the present invention, is to reduce noise transmitted from a motor compressor unit.

Another object of this invention is to locate a fibrous material within a shell of a motor compressor unit to dampen sound waves generated therein.

A further object of the present invention is to employ a lubricant of a motor compressor unit to dampen a fibrous material located therein while separating the fibrous material from the main lubricant supply of the unit.

These and other objectives are attained with a motor compressor unit comprising compressor means for compressing a vapor, motor means for driving the compressor means, a shell encompassing the compressor and motor means, and a supply of lubricant disposed within the shell. The motor compressor unit further comprises a lubricant absorbent, fibrous material positioned against interior surfaces of the shell for dampening sound waves generated within the motor compressor unit, and a cover located between the lubricant supply and the fibrous material for separating the fibrous material from the lubricant supply and preventing contamination thereof by the fibrous material.

A BRIEF DESCRIPTION OF THE DRAWING

The sole FIGURE is a side longitudinal view partly in cross section of a motor compressor unit illustrating teachings of the present invention.

A DETAILED DESCRIPTION OF THE PREFERRED EMBODIMENT

Referring to the drawing, there is shown motor compressor unit 10 illustrating teachings of the present invention.

Unit 10 includes casing or shell 12, electric motor 14, compressor 16, lining 20, and cover 22, with the motor, compressor, lining, and cover all disposed within the shell. A supply of lubricant 24 such as oil is stored in a sump or reservoir of shell 12 and, during operation of unit 10, oil is drawn into compressor 16 to lubricate moving parts thereof. Preferably, shell 12 includes top and bottom halves 26 and 30 which are welded together to hermetically seal unit 10. It should be made clear, however, that other types of motor compressor units, for example semi-hermetically sealed units, are well known in the art and may also be employed in the practice of the present invention.

Motor compressor unit 10 is well adapted for use in a refrigeration or air conditioning circuit. Low pressure refrigerant vapor enters unit 10 via inlet 32, flows over motor 14, cooling the motor, and then enters compressor 16. At the same time, motor 14 is employed to drive compressor 16, which compresses the vapor passing thereinto. After being compressed, the vapor is discharged from compressor 16 and unit 10 via an outlet line (not shown) and thence circulated through the rest of the refrigeration or air conditioning circuit. In the course of operation of motor compressor unit 10, the numerous moving parts thereof generate sound waves which, if transmitted to the surrounding ambient, may exceed predefined preferred noise levels. In view of this, motor compressor unit 10 is uniquely designed in accordance with the present invention to dampen sound waves generated therein.

Lining 20 and cover 22 play principal roles in this sound dampening. Referring to lining 20 in greater detail, the lining is comprised of a lubricant absorbent, fibrous material, for example material sold under the trademark Dacron may be used. Lining 20 is positioned against interior surfaces of shell 12 and preferably annularly extends around compressor 16. Preferably lining 20 also covers the bottom of shell 12 and extends upward above lubricant supply 24.

Cover 22 is provided for separating lining 20 from lubricant supply 24 and preventing contamination thereof by lining material, which may break away from the lining during the lifetime of motor compressor unit 10. More particularly, cover 22 is formed of relatively thin sheet metal and has a stiffness which permits slight bending without deformation. Cover 22 overlays lining 20 and preferably is substantially contiguous with an inside surface thereof. However, it should be noted that upper edges 34 of lining 20 are not covered by cover 22 and, thus, are exposed to the environment within shell 12, specifically to vapor within the shell. Cover 22 may be secured to shell 12 in any conventional manner, for example via connecting brackets (not shown) extending between the cover and the shell. With cover 22 secured to shell 12, lining 20 is securely held in place between the cover and the shell by pressure contact between the shell, the lining, and the cover. Preferably, as shown in the drawing, edge 34 of lining 20 is located at the top of the lining and defines a horizontal plane, and cover 22 includes an upper edge located at the top of the cover and vertically coterminous with edge 34 of lining 20.

During operation of unit 10, lubricant from supply 24 moistens lining 20. More specifically, as lubricant from reservoir 24 passes through compressor 16 to lubricate surfaces thereof, some of this lubricant becomes entrained with the refrigerant also passing through the compressor. This entrained lubricant flows through the refrigeration or air conditioning circuit with the refrigerant and reenters shell 12 via inlet 32. Some of this lubricant flows onto edges 34 of lining 20 and is collected by those edges and therefrom lubricant migrates and is drawn throughout the lining via capillary action. As the fibrous material of lining 20 is wetted or moistened, the material becomes resilient, and this resiliency acts to dampen sound waves generated within motor compressor unit 10.

That is, sound waves generated within unit 10 travel outward and vary the pressure on cover 22. As the sound waves increase the pressure on cover 22, the sound waves push the cover outward toward shell 12, compressing lining 20 between the shell and the cover. Thus, energy of the sound waves is conducted through cover 22 and transformed into potential energy of the compressed lining 20, reducing the energy in the sound waves. As the pressure on cover 22 reduces, lining 20 expands, tending to return the lining and the cover to their original shape and position. As sound waves continue to be generated within unit 10, this compression-expansion cycle of lining 20 and cover 22 also continues, effectively muting the sound waves.

While it is apparent that the invention herein disclosed is well calculated to fulfill the objects above stated, it will be appreciated that numerous modifications and embodiments may be devised by those skilled in the art, and it is intended that the appended claims cover all such modifications and embodiments as fall within the true spirit and scope of the present invention.

I claim:

1. A motor compressor unit comprising:

a shell;

compressor means located within the shell for compressing a vapor;

motor means located within the shell for driving the compressor means;

a supply of lubricant disposed within the shell;

a lubricant absorbent, fibrous material positioned against interior surfaces of the shell for dampening sound waves generated within the motor compressor unit, extending above the lubricant supply, and including an edge exposed to vapor within the shell, wherein lubricant entrained in vapor inside the shell flows onto said exposed edge and therefrom migrates throughout the lining; and a cover positioned between the lubricant supply and the fibrous material for separating the fibrous material from the lubricant supply and preventing contamination thereof by the fibrous material.

2. A motor compressor unit as defined by claim 1 wherein the cover is substantially contiguous with an inside surface of the fibrous material.

3. A motor compressor unit as defined by claim 1 wherein the fibrous material and the cover annularly extend around the compressor means and cover a bottom of the shell.

4. A motor compressor unit as defined by claim 3 wherein:

the edge of the fibrous material is located at the top of the fibrous material and defines a horizontal plane; and the cover includes an upper edge located at the top of the cover and vertically coterminous with the edge of the fibrous material.

5. A method of reducing noise transmitted from a motor compressor unit of the type having a shell, a lubricant supply disposed therein, a lubricant absorbent, fibrous material positioned against interior surfaces of the shell, and a cover separating the lubricant absorbent material from the lubricant supply, the method comprising the steps of:

wetting the lubricant absorbent material with lubricant;

drawing lubricant throughout the lubricant absorbent material, wherein the lubricant absorbent material becomes resilient; and conducting energy in sound waves generated within the motor compressor unit through the cover to compress the lubricant absorbent material between the shell and the cover and to transform energy in the sound waves into potential energy of the lubricant absorbent material, dampening the sound waves generated within the motor compressor unit.

6. The method of claim 5 wherein:

the wetting step includes the step of wetting an upper edge of the lubricant absorbent material with lubricant entrained in vapor within the shell; and the drawing step includes the step of drawing lubricant from said upper edge, throughout the lubricant absorbent material.

* * * * *